US005971217A

United States Patent [19]

Visola et al.

[11] Patent Number: 5,971,217

[45] Date of Patent: Oct. 26, 1999

[54] LIQUID STORING AND DISPENSING SYSTEM

[75] Inventors: Joseph E. Visola; Richard D. Haasnoot, both of Modesto, Calif.

[73] Assignee: E. & J. Gallo Winery, Modesto, Calif.

[21] Appl. No.: 08/996,152

[22] Filed: Dec. 22, 1997

[51] Int. Cl.[6] ..... B67D 5/06; B65D 90/02; B65D 25/24

[52] U.S. Cl. ..... 222/185.1; 215/379; 220/638

[58] Field of Search ..... 222/185.1; 215/379, 215/382; 220/631, DIG. 6

[56] References Cited

U.S. PATENT DOCUMENTS

| | | | |
|---|---|---|---|
| D. 73,990 | 11/1927 | Young . | |
| D. 134,077 | 10/1942 | Clark . | |
| D. 136,997 | 1/1944 | Clark . | |
| D. 148,165 | 12/1947 | Homan . | |
| D. 207,129 | 3/1967 | Kelly . | |
| D. 214,973 | 8/1969 | Amand . | |
| D. 214,974 | 8/1969 | Amand . | |
| 279,915 | 6/1883 | Clark . | |
| D. 294,463 | 3/1988 | Lang . | |
| 1,595,040 | 8/1926 | Voss . | |
| 2,197,352 | 1/1940 | Terkel . | |
| 2,537,468 | 1/1951 | Lanius, Jr. . | |
| 2,702,563 | 2/1955 | Snyder et al. . | |
| 2,793,788 | 5/1957 | Lysne . | |
| 3,054,535 | 9/1962 | Clarey | 222/215 |
| 3,067,890 | 12/1962 | Veyrie . | |
| 3,195,752 | 7/1965 | Cox . | |
| 3,217,950 | 11/1965 | Goodson . | |
| 3,223,296 | 12/1965 | Waddington et al. . | |
| 3,308,224 | 3/1967 | Waddington et al. . | |
| 3,329,164 | 7/1967 | Symonds et al. . | |
| 3,348,848 | 10/1967 | Lucking et al. . | |
| 3,378,035 | 4/1968 | Waddington et al. . | |
| 3,460,715 | 8/1969 | Lane et al. . | |
| 3,474,927 | 10/1969 | Bowles . | |
| 3,589,542 | 6/1971 | Dillon . | |
| 3,757,984 | 9/1973 | Barton | 220/27 |
| 3,805,995 | 4/1974 | Lebel et al. . | |
| 3,885,698 | 5/1975 | Lebel et al. . | |
| 4,105,141 | 8/1978 | Lane et al. . | |
| 4,193,524 | 3/1980 | Fleming . | |
| 4,257,558 | 3/1981 | Mason, Jr. . | |
| 4,452,425 | 6/1984 | Lucking . | |
| 4,471,807 | 9/1984 | Lucking et al. . | |
| 4,475,566 | 10/1984 | Haines . | |
| 4,709,821 | 12/1987 | Guiffray | 215/382 |
| 4,802,610 | 2/1989 | Cheek et al. | 222/481.5 |
| 4,844,290 | 7/1989 | McCurdy et al. . | |
| 4,869,370 | 9/1989 | Rohmann . | |
| 4,871,096 | 10/1989 | Horian . | |
| 4,877,142 | 10/1989 | Doering . | |
| 4,911,334 | 3/1990 | Kedzierski . | |
| 4,925,068 | 5/1990 | Schneider . | |
| 4,928,860 | 5/1990 | Knight | 222/466 |
| 4,949,861 | 8/1990 | Cochran . | |
| 5,050,757 | 9/1991 | Hidding et al. . | |
| 5,067,622 | 11/1991 | Garver et al. . | |
| 5,118,015 | 6/1992 | Scholle et al. . | |
| 5,122,399 | 6/1992 | Farrell et al. . | |
| 5,123,460 | 6/1992 | Reed . | |
| 5,211,313 | 5/1993 | Lucking et al. . | |
| 5,337,775 | 8/1994 | Lane et al. . | |
| 5,350,078 | 9/1994 | Potts et al. . | |
| 5,499,730 | 3/1996 | Harbour . | |

*Primary Examiner*—Andres Kashnikow
*Assistant Examiner*—Keats Quinalty
*Attorney, Agent, or Firm*—Burns, Doane, Swecker & Mathis, L.L.P.

[57] ABSTRACT

A liquid storage and dispensing device includes a bottle and a fluid flow control device which is mounted to the neck of the bottle. The bottle includes a planar surface upon which the bottle may rest in an inclined orientation, with the neck of the bottle pointed down. The planar surface is formed at an angle with respect to the rest of the bottle geometry so that the center of gravity of the bottle, when full of liquid and in the inclined orientation, is above the planar surface. Thus, the full bottle is able to be safely stored in the inclined orientation with any level of liquid contained in the bottle, without concern that the bottle will topple over, and the liquid contents may be dispensed through the fluid flow control device.

37 Claims, 7 Drawing Sheets

LIQUID STORING AND DISPENSING SYSTEM

BACKGROUND OF THE INVENTION

1. Field of the Invention

The present invention relates to liquid containers, and more particularly to rigid bottles including a dispensing valve for dispensing liquid contents from a bottle.

2. Brief Description of the Related Art

Liquid vessels have been used in the past to store and dispense their liquid contents using a variety of mechanisms. For example, it is known to use a flexible polymer bag equipped with a valve, housed within a paperboard box with the valve extended through the box wall, to store and dispense liquids, e.g., wine. These prior devices typically allow access via the valve to the liquid contents of the bag while the "bag-in-box" is located on a shelf. Other prior devices for storing and dispensing liquids include polymer bottles mounted on a stand, such as a water cooler, and glass and polymer bottles which do not include a valve which controls the flow of liquid from the bottle.

These prior devices suffer from numerous deficiencies. Since the bag-in-box unit requires that the bag collapse in order to dispense its liquid contents, the bag must be formed of a flexible material, which is typically a polymer material. To protect the bag, it must be housed in a cardboard box. These polymer materials from which the bags are made can effect the taste of the liquid contents to an end user, and may not be entirely impermeable to air. Thus, liquids stored in and dispensed from bag-in-box type devices must be used relatively quickly, before their palate is affected by the aforementioned influences. Furthermore, because the bags themselves are relatively flaccid, they cannot support themselves on a shelf, and are therefore required to be housed in a box.

Small glass or polymer bottles are relatively easy for a consumer to use, but large, jug-type bottles are heavy. When placed in the refrigerator, the jug must be lifted out of the refrigerator to pour a small quantity for drinking. The jug must then be returned to the refrigerator shelf. The awkward handling of the heavy jug by the consumer may discourage a consumer from buying the liquid product in this economical size container.

SUMMARY OF THE INVENTION

According to one embodiment of the present invention, a liquid container and dispensing system includes a rigid container having a base portion and a neck section forming a mouth through which liquid contents may be dispensed from the container, the base portion having a bottom surface for supporting the container with the neck section extending substantially perpendicular to the bottom surface. The container also includes a shoulder section extending between the base portion and the neck section, the shoulder section having a substantially flat support surface that intersects the bottom portion at a transition zone forming an acute angle. A dispensing valve means is provided for controlling the flow of liquid out of the container through the mouth of the container. The container, when filled with liquid, has a center of gravity which is located between the mouth of the container and an axis extending perpendicular to the support surface at the transition zone, whereby the container is stable in an upright position supported by the bottom of the container and in a pouring position with the support surface of the container resting on a horizontal surface.

According to another embodiment of the present invention, a liquid container and dispensing system comprises a rigid container having a base portion and a shoulder portion, the base portion having a substantially flat bottom surface and the shoulder portion having a neck section at one end and being joined to the base portion at the other end. The shoulder portion includes a substantially flat support surface extending between the neck section and a transition zone at the junction with the base portion. The neck section has a substantially cylindrical mouth, the central axis of the mouth being substantially perpendicular to the bottom surface of the container.

According to yet another embodiment of the present invention, a liquid container and dispensing system comprises a glass container having a base portion and a shoulder portion, the shoulder portion having a pair of substantially flat support surfaces on opposite sides of the container, and a neck section between the support surfaces. The base portion has a side and a bottom, and the bottom has a substantially flat surface. The shoulder portion is integrally joined to the side of the base portion, and the support surfaces of the shoulder portion form an acute angle with the side. Dispensing valve means are provided for selectively dispensing liquid from the container through the neck portion, the valve means including means for introducing air into the container while liquid is being dispensed from the container. The container may be placed upright on its bottom surface, and may also be positioned for dispensing liquid when positioned with one of the support surfaces on a horizontal surface.

In accordance with the present invention, a bottle includes a planar surface which forms an angle with the longitudinal axis of the bottle, a bottom surface, and a dispensing valve. The bottle can advantageously be rested on the bottom surface in an upright position on a store shelf for presentation to consumers, and rested on the planar surface of the bottle on a support surface, e.g., a shelf in a refrigerator, for allowing the contents of the bottle to be dispensed through the dispensing valve while simultaneously venting air into the bottle to break any vacuum created therein. The bottle is one-piece, which presents significant advantages over multi-piece bag-in-box devices.

Still other objects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

Preferred embodiments of the invention are illustrated in the accompanying drawings, in which.

DESCRIPTION OF THE PREFERRED EMBODIMENTS

Figure 1:
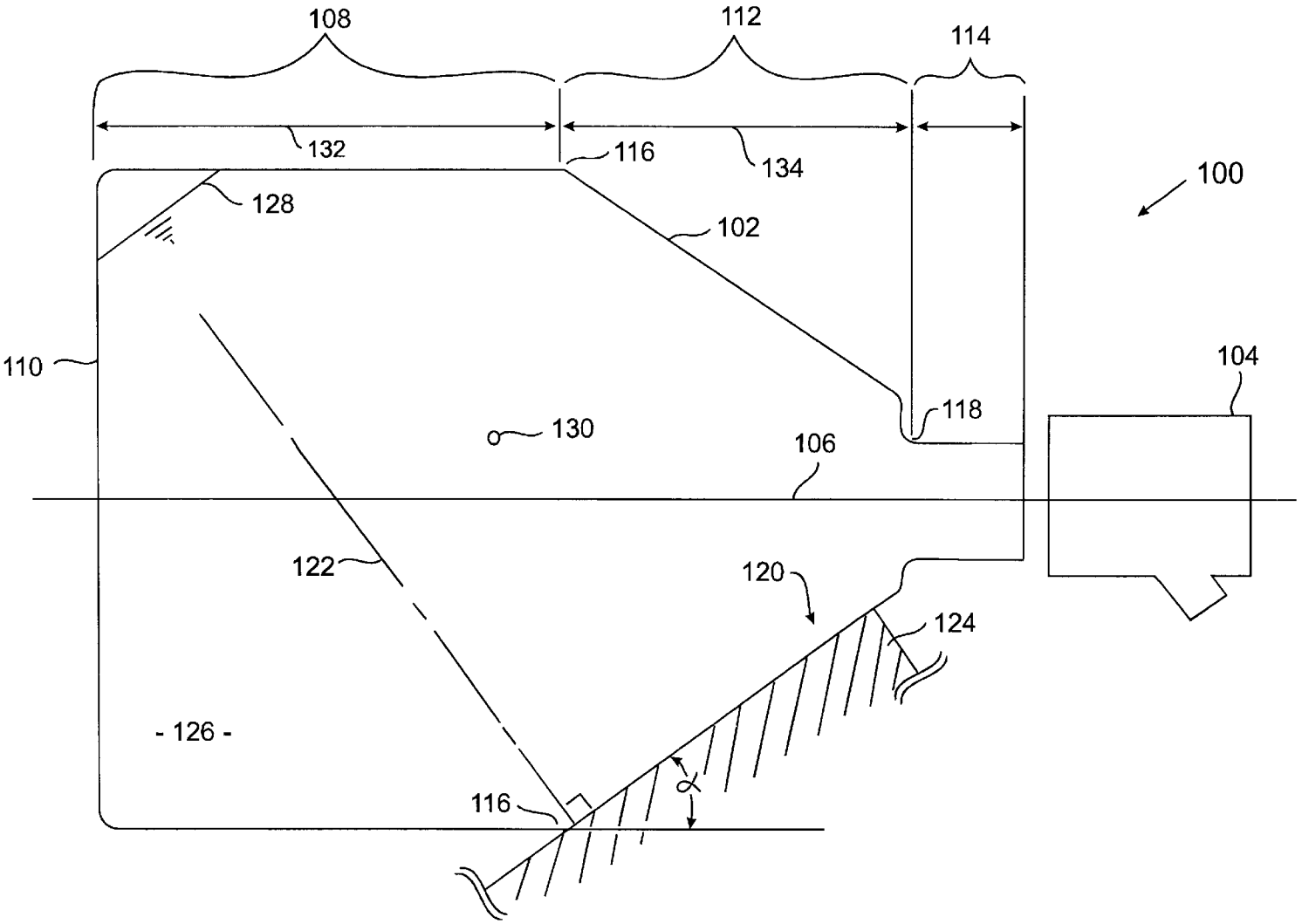
FIG. 1 is a schematic view of a liquid storing and dispensing system in accordance with the present invention.

Referring to the drawing figures, like reference numerals designate identical or corresponding elements throughout the several figures.

In the drawing figures, FIG. 1 illustrates a preferred embodiment of the liquid storing and dispensing system 100 according to the present invention. The liquid storing and dispensing system 100 includes a bottle 102 and a fluid flow control device 104. The fluid flow control device 104, preferably a valve arrangement, attaches to a proximal portion of the bottle 102 as will be described in greater detail below.

The bottle 102 is shown schematically in FIG. 1 and includes several sections along its center or longitudinal axis 106. A distal bottom section 108 begins at the bottom 110 of the bottle 102 and has a generally uniform cross-sectional profile. A shoulder section 112 is adjacent the bottom section 108. A neck section 114 is provided adjacent the shoulder section 112. The bottom section 108 and shoulder section 112 abut each other at a bottom-shoulder transition zone 116, and the shoulder section and the neck section 114 abut each other at a shoulder-neck transition zone 118. As will be readily appreciated by one of ordinary skill in the art, the bottom-shoulder transition zone 116 and the shoulder-neck transition zone 118 are merely reference points and, since the bottle is preferably formed of a rigid material, such as glass, the transition zones are formed integrally when the bottle is formed.

The shoulder section 112 includes a support section 120 upon which the bottle 102 may rest in an inclined or tilted orientation, as illustrated in FIG. 1. The shoulder support section 120 defines an angle a with a line parallel to the center longitudinal axis 106 of the bottle 102. The shoulder support section 120 has a sufficient area to support the bottle at a tilt angle $\alpha$ on a resting surface 124, as shown schematically in FIG. 1.

As will be readily appreciated by one of ordinary skill in the art, in the inclined orientation, when the bottle 102 is filled with liquid, and the support section 120 rests on the surface 124, gravity acts along the direction of a perpendicular axis 122. The liquid 126 will shift in the bottle according to the local gravity field, i.e., the liquid contents of the bottle flow quickly and resettle in the lowest portions of the bottle relative to the local gravity field. The local gravity field is perpendicular to resting surface 124 as represented by the axis 122. Since there is slightly less of the liquid 126 in the bottle 102 than the entire volume of the bottle, the liquid assumes a liquid level 128 in the bottom section 108. As the liquid 126 is dispensed from the bottle 102, the liquid level 128 in the inclined position moves down along the perpendicular axis 122 until, when all the liquid has been dispensed from the bottle, the liquid level is also in the shoulder section 112, and the bottle is nearly empty.

In the inclined orientation of the bottle 102, the center of gravity 130 of the combination of the bottle 102 and its liquid contents 126 is to the right of perpendicular axis 122, which intersects the bottle at bottom-shoulder transition zone 116. The bottom-shoulder transition zone 116 is immediately adjacent to or in contact with the resting surface 124. According to the present invention, this compound center of gravity 130 of the bottle 102 (when full) is selected to be to the right of the perpendicular axis 122 and, therefore, spaced in the direction of gravity force over the shoulder support section 120, which thereby ensures the stability of the bottle on the resting surface when in the inclined orientation.

The specific geometry defined by the bottom section 108, the shoulder section 112, and shoulder support section 120, as well as the volumes and masses of the bottle section, the shoulder section, the neck section 114, and the liquid 126 contained in the bottle, determines where the center of gravity 130 of the bottle and liquid is, according to well-established principles of statics engineering. The volume of liquid 126 and the portion of the wall of the bottle 102 that is located to the left of the perpendicular axis 122, as illustrated in FIG. 1, tends to tip the bottle in a counter-clockwise direction about the transition zone 116, while the liquid contents of the bottle and the portion of the wall of the bottle to the right of the perpendicular axis 122 tends to tip the bottle in a clockwise direction about the transition zone 116. Thus, according to the present invention, the bottle 102 is constructed, and specifically the bottom section 108 and the shoulder section 112 are constructed, such that the center of gravity 130 of the bottle, when full, is to the right and toward the neck section, and preferably substantially to the right, of the perpendicular axis 122 when the bottle is in the inclined orientation. This is achieved by selecting the length 132 of the bottom section 108 along the center longitudinal axis 106, as well as the length 134 of shoulder section 112 as measured along center longitudinal axis 106, and shoulder tilt angle $\alpha$ so that center of gravity 130, when bottle 102 is filled with liquid 126, is located to the right of the shoulder perpendicular axis 122.

If the length 132 of the bottom section 108 is made larger, while holding the length 134 of the shoulder section 112 and the shoulder tilt angle a constant, the center of gravity 130 moves to the left, as viewed in FIG. 1, thus making the bottle less stable when in the tilted orientation. Depending upon the particular cross-sectional profiles of the bottle 102, extension of the length 132 of the bottom section 108 beyond a particular critical point, holding the length 134 of the shoulder section 112 and the shoulder tilt angle $\alpha$ constant, makes the bottle 102, when full of the liquid 126, unstable, i.e., the center of gravity 130 has moved to the left past the perpendicular axis 122 and into that section of the bottle which is suspended above the resting surface 124. In this unstable configuration, the bottle 102 is unable to remain on the resting surface 124 when full, and will tilt back and up (counter-clockwise as illustrated in FIG. 1), thereby raising the neck section 114 relative to the resting surface, and making the fluid pressure head smaller between the resultant liquid level 128 and the neck section than in the orientation illustrated in FIG. 1.

If the length 134 of the shoulder section 112 is increased, while holding the length 132 of the bottom section 108 and the shoulder tilt angle $\alpha$ constant, an effect opposite of that discussed above with respect to the length 132 of the bottom section 108, is created. That is, increasing the length 134 of the shoulder section 112 increases the volume of liquid 126 contained in the bottle 102 (when full) to the right of the perpendicular axis 122 and above the resting surface 124. An increase in this volume to the right of perpendicular axis 122, as illustrated in FIG. 1, further stabilizes the bottle when in the tilted orientation, because the additional volume of liquid to the right of the perpendicular axis moves the center of gravity 130 further to the right of the perpendicular axis and toward the neck section 114, as illustrated in FIG. 1.

Changing the shoulder tilt angle α, while holding the length 132 of the bottom section 108 and the length 134 of the shoulder section 112 constant, also effects the location of the center of gravity 130 of the bottle 102 (when full), relative to the perpendicular axis 122. As illustrated in FIG. 1, making the shoulder tilt angle α smaller effectively pivots the perpendicular axis 122 an equal amount in a clockwise direction, thus sweeping out a larger portion of the bottle 102 and its liquid contents. Thus, reduction of the shoulder tilt angle α directly results in a less stable configuration of the bottle 102 when full of the liquid 126 intended to be dispensed therefrom, because relatively more of the bottle and its liquid contents are to the left of the perpendicular axis 122 when a is smaller, as discussed in greater detail above with respect to changing the length 132 of the bottom section 108. Similarly, an increase in the shoulder tilt angle a pivots the perpendicular axis 122 counter-clockwise, as illustrated in FIG. 1, and thus relatively more of the bottle 102 and its liquid contents are swept to the right of the perpendicular axis 122. Thus, smaller values of α tend to move the center of gravity 130 to the left relative to the perpendicular axis 122, making the bottle (when full) less stable; larger values of α tend to move the center of gravity 130 to the right, lending to the stability of the bottle 102 when full.

It has been found that satisfactory stability will be obtained when the angle α is between 25 degrees and 45 degrees, but the practical range for the angle α is between 15 degrees and 75 degrees, provided the center of gravity of the container is located in a position that will cause the container to be stable when resting on the shoulder support section 120.

The fluid flow control device 104, illustrated in FIG. 1, is designed to attach to the neck section 114 of the bottle 102, to sealingly and controllably dispense liquid from the bottle. The fluid flow control device 104 can, as will be readily appreciated by one of ordinary skill in the art, take any other number of configurations, which allows a user to control the flow of the liquid 126 from the bottle 102, through the fluid flow control device 104, and out of the fluid flow control device.

Figure 2:
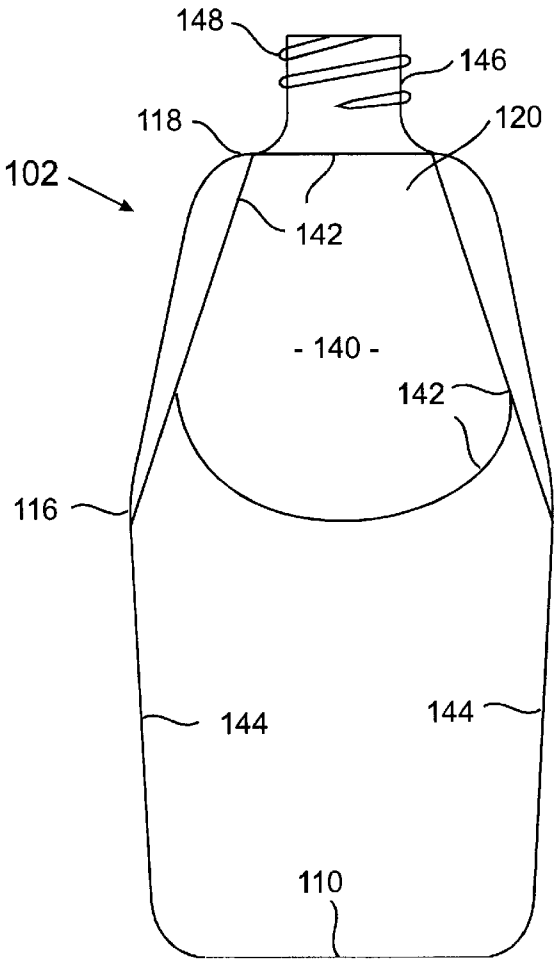
FIG. 2 is a left side elevational view of portions of the system illustrated in FIG. 1.

Turning now to FIGS. 2–7, an exemplary embodiment of the bottle 102 in accordance with the present invention is illustrated. In FIG. 2, the bottle 102 includes a shoulder support section 120 which is flat or planar, for supporting the bottle when in an inclined or tilted orientation. A planar surface 140 extends from bottom-shoulder transition zone 116 to the shoulder-neck transition zone 118, and has an area which is sufficient to provide stability to the bottle 102 and its liquid contents 126 when full and in an inclined orientation. The planar surface 140 is bounded at transition segments 142 on all sides, illustrated by lines in FIG. 2. As will be readily appreciated by one of ordinary skill in the art, the transition segments 142 can take the form of sharp edges, or gentle curve transitions between planar surface 140 and the adjoining surfaces. A neck 146 is provided in the neck region 114, and includes external threads 148, for mating with correspondingly shaped threads on a sealing device, as will be discussed in greater detail below.

As illustrated in FIG. 2, the side wall 144 of the bottom section 108 tapers slightly from bottom-shoulder transition zone 116 to the bottom 110, relative to a perpendicular. The side wall 144 of bottom section 108 may taper more or less without departing from the spirit and scope of the present invention.

Figure 3:
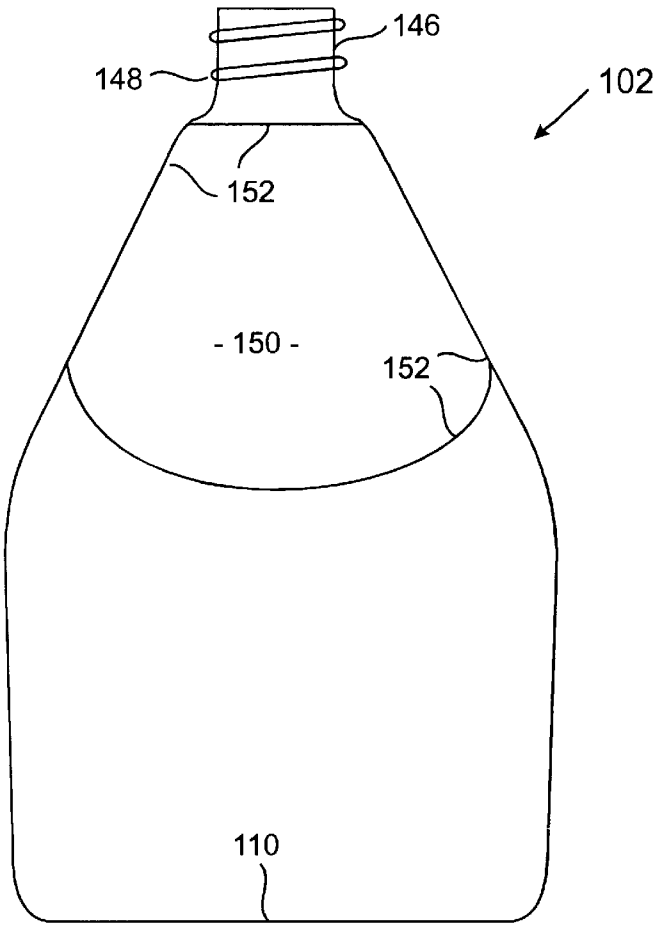
FIG. 3 is a front elevational view of portions of the system illustrated in FIG. 1.

Turning now to FIG. 3, the bottle 102 includes a label panel surface 150 which is circumferentially adjacent the planar surface 140. As illustrated in FIG. 6, the label panel surface 150, in the embodiment illustrated in FIG. 2–7, has a gently curving profile from the planar surface transition segment 142, at which the label panel surface 150 abuts the planar surface, circumferentially around to a side of the bottle 102 diametrically opposite the planar surface 140. The label panel surface 150 is bounded on all sides by transition segments 152 which, similar to the planar surface transition segments 142, may be either relatively sharply defined in the surface of the bottle 102, or, in an embodiment not illustrated, gently blend from the label panel surface 150 to adjoining surfaces. As illustrated in FIG. 3, the label panel surface 150 extends towards the bottom 110 of the bottle 102 to approximately the same point as does the planar surface; however, the label panel surface 150 may extend further than or not as far as the planar surface 140 relative to the bottom 110, without departing from the spirit and scope of the invention.

Figure 4:
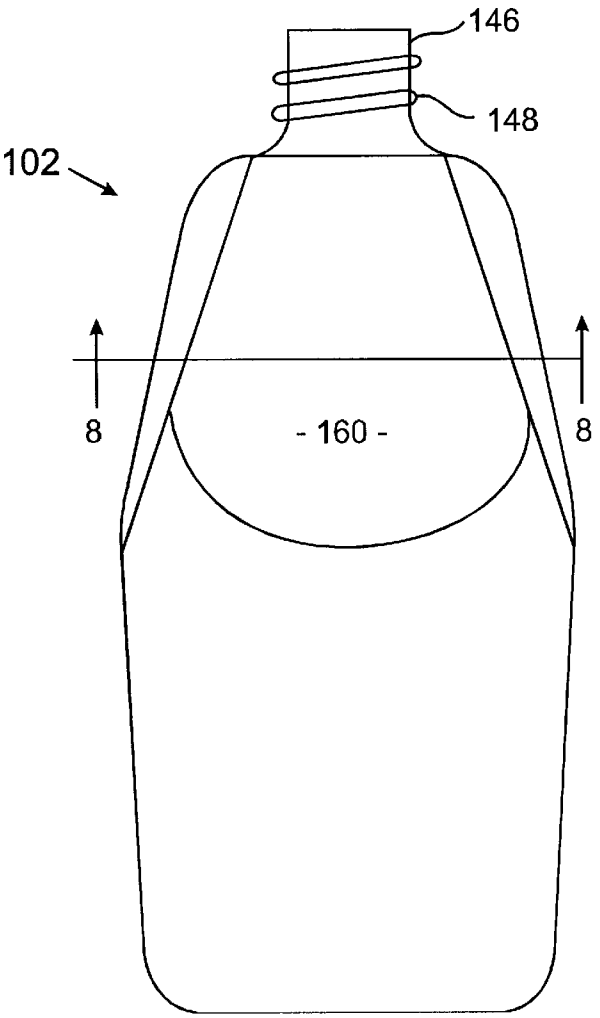
FIG. 4 is a right side elevational view of portions of the system illustrated in FIG. 1.

Turning now to FIG. 4, the embodiment of the bottle illustrated in FIGS. 2–7 is preferably provided with a second planar surface 160, substantially similar to the planar surface 140 illustrated in and described with reference to FIG. 2. The bottle 102 may be constructed without the second planar surface 160 without departing from the spirit and scope of the invention, and may instead may be provided with a slightly curving surface, somewhat similar to the label panel surface illustrated in FIG. 3. When the bottle 102 is provided with the second planar surface 160, the second planar surface 160 is preferably substantially similar to the planar surface 140 illustrated in FIG. 2.

Figure 5:
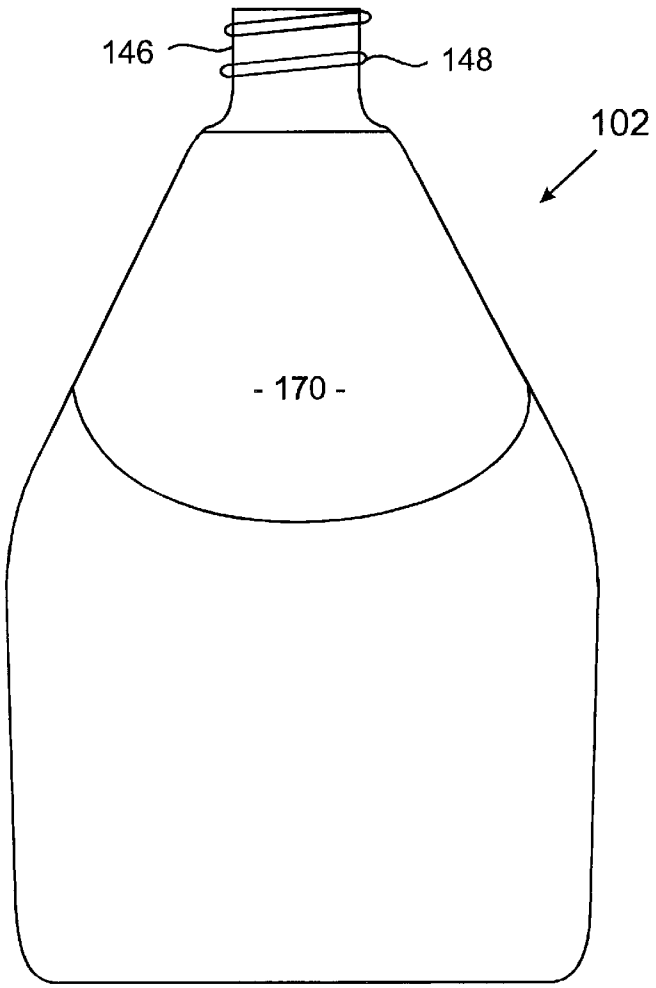
FIG. 5 is a rear elevational view of portions of the system illustrated in FIG. 1.
Figure 6:
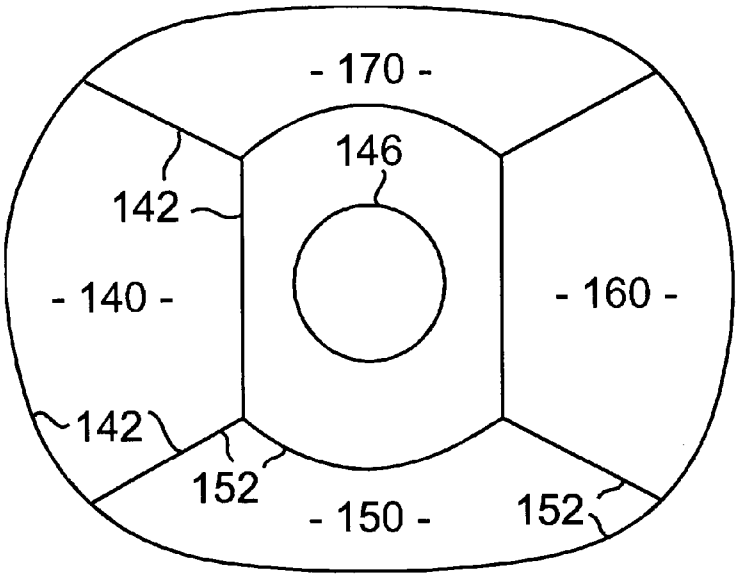
FIG. 6 is a top plan view of portions of the system illustrated in FIG. 1.

FIG. 5 illustrates a rear view of the bottle 102 according to the present invention. The rear of the bottle 102 preferably includes a second label panel surface 170, substantially similar to the label panel surface 150 illustrated in and discussed with reference to FIG. 3.

FIGS. 2–5 illustrate the neck 146 including threads 148 thereon. The threads 148 are provided for mating with a cap or other sealing device (not illustrated in FIGS. 2–7) for retaining the liquid contents of the bottle 102 therein. The embodiment of the bottle 102 illustrated in FIG. 2–7 includes the threads 148 for mating with such a sealing structure (not illustrated); other structures instead of threads, such as an outwardly extending lip, grooves, or the like, may be provided instead of the threads without departing from the spirit and scope of the invention.

Turning now to FIG. 6, a top view of the bottle 102 according to the present invention is illustrated. FIG. 6 illustrates the bottle 102 including the first planar surface 140, the label panel surface 150, the second planar surface 160, and the second label panel surface 170, as described above with reference to FIGS. 2–5. Also illustrated in FIG. 6, the bottle 102 defines, at its widest cross-section, which is approximately at bottom-shoulder transition zone 116, and approximately oval-like cross-sectional shape. Other cross-sectional shapes, such as circular, square, or rectangular, may also be used without departing from the spirit and scope of the invention. In the event that a cross-sectional shape is chosen which is not smooth or which does not define four sides, one or more of the surfaces 140, 150, 160, 170, illustrated in and described with reference to FIGS. 2–5, may be eliminated without departing from the spirit and scope of the invention. Preferably, if more or fewer surfaces are provided, at least one of the external surfaces of the bottle 102 is configured as a planar surface 140, similar to that illustrated in FIG. 2.

Figure 7:
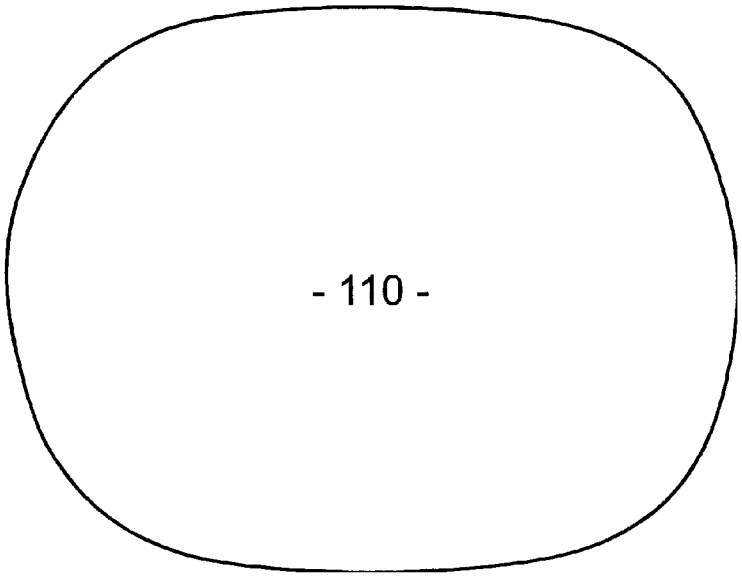
FIG. 7 is a bottom plan view of portions of the system illustrated in FIG. 1.

FIG. 7 illustrates a bottom plan view of the bottle, and illustrates a cross-sectional profile similar to that illustrated in FIG. 6, except that the profile illustrated in FIG. 7 is slightly smaller due to the slightly inward taper of the sidewall 144 defined in the bottom section 108, discussed above.

Figure 8:
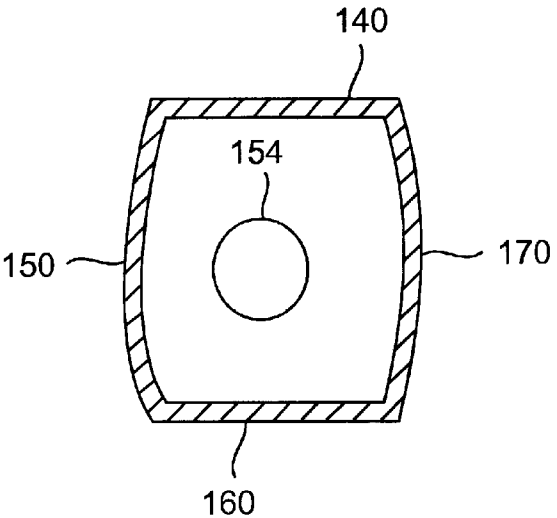
FIG. 8 is a cross-sectional view of portions of the system along the line 8—8 in FIG. 4.

FIG. 8 illustrates a cross-sectional view of the bottle taken at line 8—8 in FIG. 4. As will be readily appreciated from FIG. 8, the planar surface 140 and the first planar surface 160 are provided diametrically opposite each other; and the label panel surface 150 and second label panel surface 170 are provided diametrically opposite each other. As illustrated in FIG. 8, the neck section defines an opening or mouth 154 communicating the interior of the bottle 102 with the exterior thereof.

Figure 9:
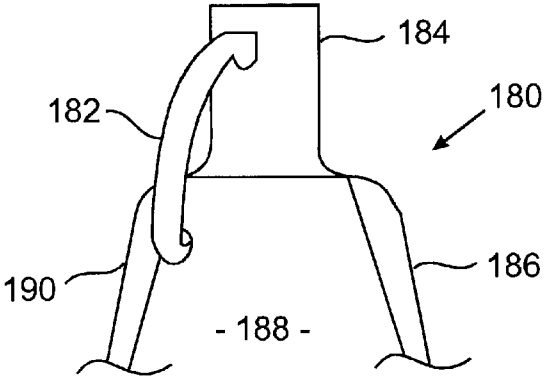
FIG. 9 is a left side detail view of portions of a modified form of the system in accordance with the present invention.

FIG. 9 illustrates yet another embodiment according to the present invention, with portions broken away. The bottle 180 illustrated in FIG. 9 further includes a handle 182 extending from a neck section 184 to a shoulder section 186.

Figure 10:
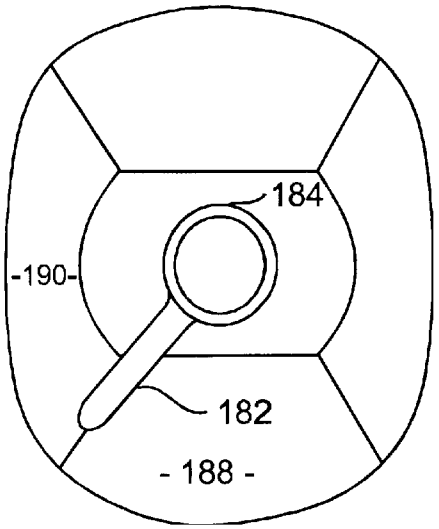
FIG. 10 is a top plan view of portions of the system illustrated in FIG. 9.

FIG. 10 illustrates a top plan view of the embodiment illustrated in FIG. 9. The handle 182 preferably is provided to extend from the neck section 184 of the bottle 180 to the shoulder section 186 thereof, approximately at the circumferential location where a planar surface 188 and a label panel surface 190 meet. The handle 182 is preferably provided at this location so that, when the bottle 180 is formed of a material which must be molded to make the bottle 180, e.g., glass, the handle 182 is approximately at the juncture of the two-mold halves (not illustrated) used to make the bottle, which aids in constructing the bottle with a handle. As will be readily appreciated by one of ordinary skill in the art, the handle 182 may be provided at any circumferential location around bottle, joining the neck section 184 and the shoulder section 186, without departing from the spirit and scope of the invention. More specifically, the handle 182 may be provided between the neck section 184 and the shoulder section 186 at the planar surface 188 or at the label panel surface 190.

The bottle 102, 180 of the present invention includes the bottom 110 so that the bottle can be rested on the bottom in an upright orientation, for example on a store shelf. This upright orientation of the bottle is advantageous and desirable for displaying a label (not illustrated) which has been placed on a label panel surface of the bottle, which conveys information to a consumer about the bottle's source and contents. The bottom 110 stably supports the bottle when in this upright configuration.

The shoulder support section 120 and the planar surface 140 allow the bottle to be stably supported in a tilted orientation for dispensing the contents of the bottle. For example, when the bottle is rested on a refrigerator shelf on the planar surface, the mouth of the bottle is positioned downward for dispensing the liquid contents from the bottle. This tilted orientation also allows air to be vented by the dispensing valve into the bottle to relieve any vacuum created in the bottle by dispensing liquid from the bottle, without interfering with the free flow of liquid from the mouth of the bottle.

Figure 11:
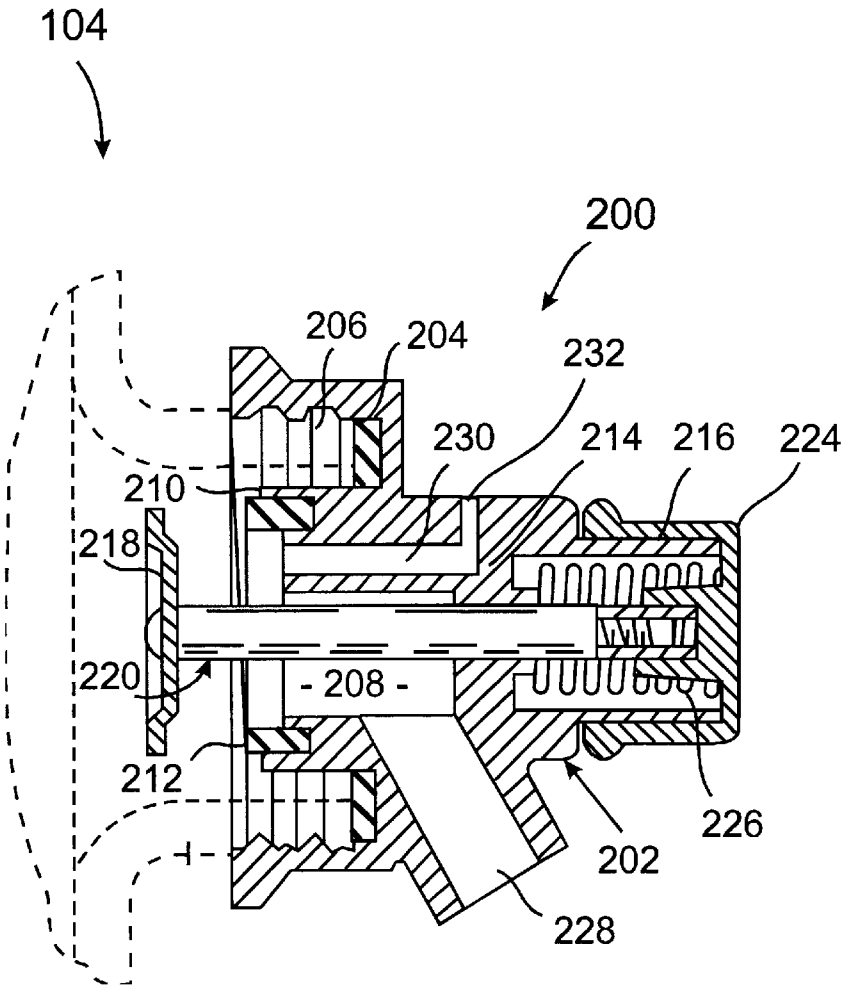
FIG. 11 is a cross-sectional view of a liquid dispensing valve for use in the system illustrated in FIG. 1.

FIG. 11 illustrates an embodiment of a fluid flow control device 104 according to the present invention. As discussed above, FIG. 11 illustrates only one of numerous fluid flow control devices useable with a bottle 102, 180 according to the present invention, for allowing a user of the liquid storage and dispensing system 100 to controllably dispense fluid from the bottle and through the fluid flow control device. As will be readily appreciated by one of ordinary skill in the art, the fluid flow control device 104 illustrated in FIG. 11 is merely exemplary of fluid flow control devices usable in the present invention.

The fluid flow control device 104 includes a valve 200 which is adapted to be secured over the mouth of the bottle 102, 180, so as to locate a tubular valve body 202 in the mouth. Through the open distal end of the valve 200, adjacent a securing collar 204, a passage 208 is formed for allowing the flow of liquid through the valve 200. In a rim 210 of the open distal end of the valve body 202, a packing 212 is provided which is made of rubber or other compressible, and preferably sterilizable material, which forms a valve seat. The other end of the valve body 202 is closed by a wall 214 on the proximal side of the valve body 202. A cylindrical hollow guide projection 216 is provided at the proximal end of the valve body 202.

A disk valve 218 fits over the valve seat 212. A valve stem 220 extends from the disk valve 218 through an aperture 222 in the end wall 214 of the valve body 202 and into the interior of the hollow guide projection 216. On the proximal end of the valve stem 220, a thumb head 224 is secured. The thumb head 224 is hollow and shaped to slidably fit over the exterior of the guide projection 216. A coil spring 226 is provided in the interior of the guide projection 216 and around the valve stem 220, and a distal end of the coil spring bears against the wall 214. The proximal end of the coil spring 226 bears against the inner face of the thumb head 224 so as to normally urge the thumb head 224 proximally and away from the valve body 202, to seat the disc valve 218 against the valve seat 212, and close off the flow of liquid through the valve 200. In order to unseat the disk valve 218, it is only necessary to press the thumb head 224 toward the valve body 202 to overcome the force of the coil spring 226.

The passage 208 for the liquid is continued in an angle so as to form a lateral spout 228 at one side of the valve body 202. Along the wall of the passage 208, opposite to the side where the spout 228 is located, a conduit 230 is provided for venting air into the bottle 102, 180. Conduit 230 is preferably integrally formed in the interior of the valve body 202. The conduit 230 extends from the distal end of the valve passage 208 to a point beyond the securing collar 204, and then radially to the outside of the valve body 202 at a point 232 substantially diametrically opposite to the location of the spout 228.

Figure 12:
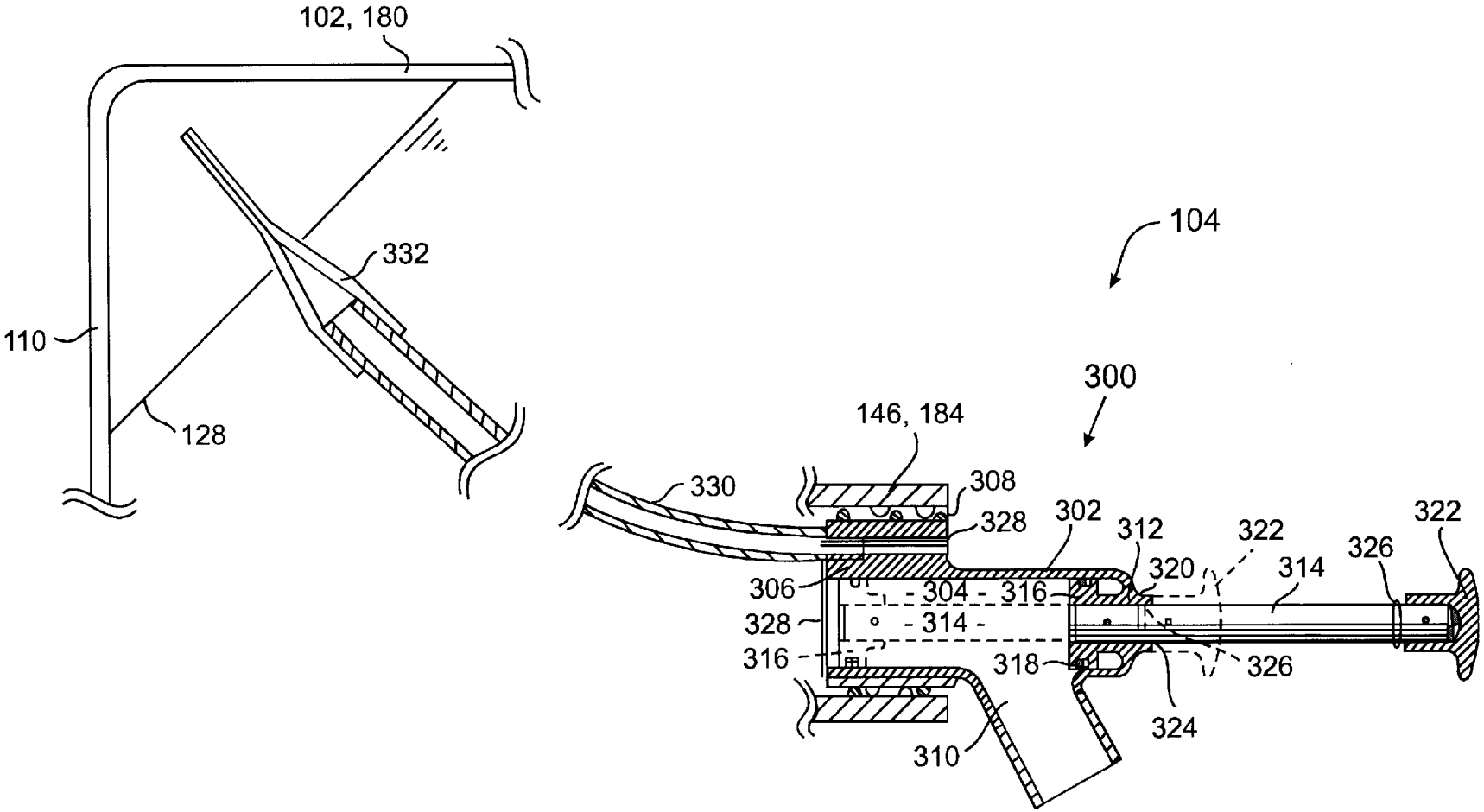
FIG. 12 is a cross-sectional view of another liquid dispensing valve for use in the system illustrated in FIG. 1.

FIG. 12 illustrates another embodiment of a fluid flow control device 104 according to the present invention. As discussed above, FIG. 12 illustrates only one of numerous fluid flow control devices usable with a bottle 102, 180 according to the present invention, for allowing a user of the liquid storage and dispensing system 100 to controllably dispense fluid from the bottle and through the fluid flow control device. As will be readily appreciated by one of ordinary skill in the art, the fluid flow control device 104 illustrated in FIG. 12 is merely exemplary of fluid flow control devices usable in the present invention.

The fluid flow control device 104, in the embodiment illustrated in FIG. 12, includes a valve 300 which is adapted to be secured in the mouth of the bottle 102, 180, so as locate the tubular valve body 302 in the mouth. Valve 300 includes a generally tubular valve body 302 including a fluid flow passage 304.

The distal end of the fluid flow passage 304 is bounded by an enlarged cylindrical portion 306. The cylindrical portion 306 is provided with an external thread 308 for threadingly mating the valve body 302 with a neck 146, 184 of a bottle 102, 180. Alternatively, in an embodiment not illustrated, valve 300 may include a securing collar, similar to securing collar 204 illustrated in and described with reference to FIG. 11, for securing valve 300 to an externally threaded bottle neck.

Valve body 302 is provided with a spout 310 formed in the tubular wall portions of the cylindrical portion 306. The end of the cylindrical portion 306 terminates in a neck 312 through which extends a piston rod or valve stem 314. The end of the piston rod 314 carries a piston 316 thereon which includes a plug provided with an annular groove to seat an O-type gasket 318 therein, to thereby effect a seal with the interior bore walls of the valve body 302. The neck 312 is also provided with an interior annular groove to receive an O-type gasket 320 at the proximal end thereof so as preclude leakage of liquid outwardly along the piston rod 314.

A handle 322 is provided on the proximal end of the piston rod 314 so that the piston 316 may be selectively positioned within the bore of the valve body 302 on either side of the spout 310. In this manner, the piston 316 operates as a valve to control the flow of fluid through the fluid passageway 304 between the inlet 328 of the valve 300 and the spout 310. Valve 300 may also be provided with a spring (not illustrated) between the proximal side of piston 316 and the distal side of neck 312, which urges piston rod 314 in a distal direction, to close valve 300.

The neck 312 is provided with a slot 324 so that a pin 326, carried by the piston rod 314, may be moved therethrough. The piston rod 314 and the pin 326 may then be rotated in the slot 324 so that the piston 316 is locked in a no-flow position. In FIG. 12, the no-flow position is illustrated by the dotted line position of the piston 316, the piston rod 314, and the handle 322.

The cylindrical portion 306 of the valve body 302 defines a venting duct 328 extending between the distal end of the valve body 302 and the atmosphere. The duct 328 may be suitably counter-bored to receive an insertable sleeve 330 therein which, in turn, may have mounted thereon a flapper-type check valve 332. Sleeve 330 is preferably constructed of a relatively stiff material so that flapper-type check valve 332 is always positioned above liquid level line 128 of bottle 102, 180. The check valve 332 preferably takes the form of a sleeve made of flexible material with opposing flat wall portions and operates in a well-known manner to permit one-way flow of fluid therethrough.

The flow of liquid from bottle 102, 180 is initiated by pulling the handle 322 from the position shown by the dotted lines to that shown by the solid lines in FIG. 12. Venting air will readily flow into bottle 102, 180 through duct 328, sleeve 330, and past check valve 332 to relieve any vacuum created in the bottle, simultaneously as the liquid 126 in the bottle flows out of valve 300.

As will be readily apparent to one of ordinary skill in the art, the structure described with reference to FIG. 12 permits high flow rates to be obtained without incurring the risks and the attendant disadvantages of a valve which does not include an air vent. The present arrangement completely eliminates the gurgle affect common to decantation of fluids through a restrictive neck and can employ no extraneous springs or valves, the flexible venting member or check valve 332 being the only valve which is continuously active.

Valves 200 and 300 further preferably include, preferably in the securing collar 204 and cylindrical portion 306, respectively, a sterility seal (not illustrated) to maintain the sterility of the valve components before use. In the embodiment of the present invention illustrated in FIGS. 11 and 12, the sterility seal is a metal or plastic foil or film which is sealingly attached to the interior of the securing collar 204 and cylindrical portion 306, respectively. The sterility seal is preferably constructed of a material and a thickness such that it may readily be broken, as described in further detail below, while being resilient and robust enough to withstand the force and pressure exerted by a full bottle of liquid.

The function of the embodiments of the bottle 102, 180 illustrated in FIGS. 2–10, and the embodiments of the fluid flow control device 104 illustrated in FIGS. 11 and 12, when used together, will now be described with reference to the drawing Figures. When it is desirable to dispense the liquid 126 from the bottle 102, 180, the bottle is placed in its inclined orientation on the resting surface 124, with the valve 200 or 300 and spout 228, 310 extending in a downward direction. In order to break the sterility seal and allow the liquid 126 to flow from the bottle 102, 180 through the valve 200 or 300 and the spout, a user presses, e.g., with a finger, the thumb head 224 or handle 322 at its proximal end to push the valve stem in a distal direction. The distal-most portions of the valve bear upon and rupture the sterility seal, thereby allowing the liquid 126 to flow past the ruptured sterility seal and toward the spout. In the embodiment illustrated in FIG. 11, the resilience of the coil spring 226 causes the valve stem to retract in a proximal direction and seat the valve head against the valve seat, thereby closing off the flow of fluid past the valve head. In the embodiment illustrated in FIG. 12, if a spring is provided between the piston rod and neck as described above, the resilience of the spring causes the valve stem to return in a distal direction past spout 310, thereby closing off the flow of fluid through the valve.

When it is desired to dispense the liquid 126 from the bottle 102, 180 and through the valve 200 or 300 and out the spout, the user may again push (FIG. 11) or pull (FIG. 12) on the proximal portions of the valve stem, thereby moving the valve stem and opening a continuous flow passage through the valve 200 or 300. By maintaining the valve stem in the open position, the flow of liquid out of the bottle 102, 180 creates a vacuum, as will be readily apparent to one of ordinary skill in the art, in the interior of the bottle. In response to the negative pressure developed in the interior of the bottle 102, 180, air is drawn into the air vent passage 230, 328.

In the embodiment illustrated in FIG. 11, air flows past the adjacent portion of the disc valve and the valve seat, and into the interior of the bottle. The flow of air venting into the interior of the bottle 102, 180 is aided by the flow of the liquid 126 through the passage 208 by a venturi effect when the valve 200 is first opened. This venturi effect occurs when liquid fills both of the passages, and the negative pressure developed in the bottle 102, 180 begins to draw air up the air vent passage. The continued flow of liquid through adjacent portions of the liquid passage 208 creates a venturi effect and entrains liquid from the air vent passage back into the liquid passage, for passage out of the spout. In the embodiment illustrated in FIG. 12, air flows into sleeve 330 and through valve 332 into the interior of the bottle.

When a desired amount of the liquid 126 has been dispensed from the bottle 102, 180 through the valve 200, 300, the user returns the valve stem to its closed position. In the embodiment illustrated in FIG. 11, the resiliency of the coil spring returns the valve stem proximally to its pre-actuated configuration, thereby seating the disc valve against the valve seat and closing off flow of the liquid 126 and air past the valve 200. In the embodiment illustrated in FIG. 12, the user pushes in the handle 322, closing off the spout 310. If a spring is provided in the embodiment illustrated in FIG. 12, the user merely releases the handle, and the valve stem is automatically moved distally to close off the spout 310. During this process, the dynamic seal of the valve 200, 300 allows the valve stem to move proximally and distally without allowing the liquid 126 or air to move past the valve stem and into the interior portions of the thumb head 224 or past the neck 312. The dynamic seal thereby also provides a hermetic seal to aid in preventing contamination of the contents of the bottle 102, 180, by passage of contaminants along the valve stem.

In a preferred embodiment of the present invention, the length 132 of the bottom section 108 is approximately 5.5 inches (140 mm), the interior of the bottle 102, 180 is approximately four (4) fluid liters, and a is between about 15° and about 75°, preferably between about 25° and about 45°, and more preferably between about 30° and about 40°. In this preferred embodiment, the bottle 102, 180 is constructed of a transparent material, more preferably glass, and the liquid contained in the bottle is preferably wine. As will be readily appreciated by one of ordinary skill in the art, the bottle 102, 180 may also be formed of a rigid and transparent polymer, or a metal, e.g., stainless steel, without departing from the spirit and scope of the present invention. Other liquids such as fruit juices, water, oils, chemicals, and the like, may also be contained in and dispensed from the bottle 102, 180, of the present invention. Preferably, the valve housing is constructed of a sterilizable and inexpensive material, e.g., metal or polymers, and more preferably formed of a polyethylene material, e.g., LDPE, HDPE, LLDPE, or mixtures thereof.

While the invention has been described in detail with reference to preferred embodiments thereof, it will be apparent to one skilled in the art that various changes can be made, and equivalents employed, without departing from the scope of the invention.

What is claimed is:

1. A liquid container and dispensing system comprising:

a wall forming a container, the wall having a base portion, and the container having a neck integral with the base portion forming a mouth through which liquid contents may be dispensed from the container, the base portion having a bottom surface for supporting the container with the neck extending substantially perpendicular to the bottom surface, said wall being formed of a material that is substantially rigid;

the container wall including a bottom portion extending from the base portion and the container wall including a shoulder extending between the bottom portion and the neck, the shoulder portion having a substantially flat support surface that intersects the bottom portion at a transition zone intermediate the neck and the base portion;

dispensing valve means for controlling the flow of liquid out of the container through the mouth of the container;

the container wall having a shape that when the container is filled with liquid the center of gravity is located between the mouth of the container and an axis extending perpendicular to the support surface at the transition zone, whereby the container is stable in an upright position supported by the bottom of the container and in a pouring position with the support surface of the container resting on a horizontal surface.

2. The liquid container and dispensing system according to claim 1 wherein the dispensing valve means includes means for admitting air into the container while liquid is being dispensed through the valve means.

3. The liquid container and dispensing system according to claim 1 wherein the shoulder includes a front wall and a back wall and opposite side walls, and each of the side walls has a substantially flat support surface.

4. The liquid container and dispensing system according to claim 1 wherein the base portion of the container is substantially elliptical in cross section.

5. The liquid container and dispensing system according to claim 4 wherein the base portion has a front wall and a back wall and opposite side walls, and the front and back walls have a greater width than the side walls.

6. The liquid container and dispensing system according to claim 5 wherein the flat support surface intersects one of the side walls of the base portion at the transition zone.

7. A liquid container and dispensing system in accordance with claim 1, wherein said wall material is selected from the group consisting of a glass, a polymer, and a metallic material.

8. The liquid container and dispensing system according to claim 7 wherein the container is integrally formed of glass.

9. A liquid container and dispensing system in accordance with claim 1, wherein a line extending along said substantially flat support surface intersects said neck section.

10. A liquid container and dispensing system comprising:

a wall forming a container, said wall having a base portion and a shoulder portion, the base portion having a substantially flat bottom surface and the shoulder portion having a neck at one end and being joined to the base portion at the other end, said wall being formed of a material so that said container is substantially incompressible;

the shoulder portion including a substantially flat support surface extending between the neck section and a transition zone at the junction with the base portion;

the neck section having a substantially cylindrical mouth, the central axis of the mouth being substantially perpendicular to the bottom surface of the container; and dispensing valve means for controlling the flow of liquid out of the container through the mouth of the container:

the container wall having a shape that when the container is filled wit liquid the center of gravity is located between the mouth of the container and an axis extending perpendicular to the support surface at the transition zone, whereby the container is stable in an upright position supported by the bottom surface of the container and in a pouring position with to the support surface of the container resting on a horizontal surface.

11. The liquid container and dispensing system according to claim 10, including dispensing valve means for dispensing liquid out of the mouth of the container.

12. The liquid container and dispensing system according to claim 10, wherein the base portion is substantially elliptical in cross-section.

13. The liquid container and dispensing system according to claim 12, wherein the base portion has a front wall and a back wall on opposite sides of the major axis of the elliptical cross-section and side walls on opposite sides of the minor axis of the elliptical cross-section, the transition zone being between the substantially flat support surface and one of the side walls.

14. The liquid container and dispensing system according to claim 13, wherein the shoulder portion includes a front wall and a back wall aligned with the front wall and back wall of the base portion, and the front wall and the back wall of the shoulder portion are substantially frusto-conical.

15. A liquid container and dispensing system in accordance with claim 10, wherein said wall material is selected from the group consisting of a glass, a polymer, and a metallic material.

16. A liquid container and dispensing system in accordance with claim 15, wherein said wall material is a glass.

17. A liquid container and dispensing system in accordance with claim 10, wherein a line extending along said substantially flat support surface intersects said neck section.

18. A liquid container and dispensing system comprising:

a glass container having a base portion and a shoulder portion, the shoulder portion having a pair of substantially flat support surfaces on opposite sides of the container, the container including a neck section between the support surfaces, the base portion having a side and a bottom, the bottom having a substantially flat surface;

the shoulder portion being integrally joined to the side of the base portion, the support surfaces of the shoulder portion forming an acute angle with the side;

dispensing valve means for selectively dispensing liquid from the container through the neck portion, the valve means including means for introducing air into the container while liquid is being dispensed from the container;

whereby the container may be placed upright on its bottom surface and may be positioned for dispensing liquid when positioned with one of the support surfaces on a horizontal surface.

19. The liquid container and dispensing system according to claim 18, wherein the side of the base portion includes side walls which include a pair of opposed front and back walls and a pair of opposed side walls.

20. The liquid container and dispensing system according to claim 19, wherein the front and back walls have a greater width than the side walls, and the support surfaces intersect at the respective side walls at an acute angle.

21. The liquid container and dispensing system according to claim 20 wherein the acute angle is between about 15 degrees and about 75 degrees.

22. The liquid container and dispensing system according to claim 21, wherein the acute angle is between about 25 degrees and about 45 degrees.

23. The liquid container and dispensing system according to claim 22, wherein the acute angle is between about 30 degrees and about 40 degrees.

24. A liquid container and dispensing system in accordance with claim 18, further comprising a liquid in said container having a viscosity substantially the same as water.

25. A liquid container and dispensing system in accordance with claim 24, wherein said liquid is selected from the group consisting of wine, fruit juice, and water.

26. A liquid container and dispensing system in accordance with claim 25, wherein said liquid is wine.

27. A liquid container and dispensing system in accordance with claim 18, wherein lines extending along each of said substantially flat support surfaces intersect said neck section.

28. A liquid container and dispensing system comprising:

a rigid container having a base portion and a neck section forming a mouth through which liquid contents may be dispensed from the container, the base portion having a bottom surface for supporting the container with the neck section extending substantially perpendicular to the bottom surface;

the container including a shoulder section extending between the base portion and the neck section, the shoulder section having a substantially flat support surface that intersects the bottom portion at a transition zone forming an acute angle;

dispensing valve means for controlling the flow of liquid out of the container through the mouth of the container; and a liquid in said container having a viscosity substantially the same as water;

the container having a center of gravity which is located between the mouth of the container and an axis extending perpendicular to the support surface at the transition zone, whereby the container is stable in an upright position supported by the bottom of the container and in a pouring position with the support surface of the container resting on a horizontal surface.

29. A liquid container and dispensing system in accordance with claim 28, wherein said liquid is selected from the group consisting of wine, fruit juice, and water.

30. A liquid container and dispensing system in accordance with claim 29, wherein said liquid is wine.

31. A liquid container and dispensing system in accordance with claim 28, wherein a line extending along said substantially flat support surface intersects said neck section.

32. A liquid container and dispensing system comprising:

a rigid container having a base portion and a shoulder portion, the base portion having a substantially flat bottom surface and the shoulder portion having a neck section at one end and being joined to the base portion at the other end;

the shoulder portion including a substantially flat support surface extending between the neck section and a transition zone at the junction with the base portion;

the neck section having a substantially cylindrical mouth, the central axis of the mouth being substantially perpendicular to the bottom surface of the container;

a liquid in said container having a viscosity substantially the same as water; and dispensing valve means for controlling the flow of liquid out of the container through the mouth of the container;

the container wall having a shape that when the container is filled with liquid the center of gravity is located between the mouth of the container and an axis extending perpendicular to the support surface at the transition zone, whereby the container is stable in an upright position supposed by the bottom surface of the container and in a pouring position with the support surface of the container resting on a horizontal surface.

33. A liquid container and dispensing system in accordance with claim 32, wherein said liquid is selected from the group consisting of wine, fruit juice, and water.

34. A liquid container and dispensing system in accordance with claim 33, wherein said liquid is wine.

35. A liquid container and dispensing system in accordance with claim 32, wherein a line extending along said substantially flat support surface intersects said neck section.

36. A liquid container and dispensing system comprising:

a wall forming a container, the wall having a base portion, and the container having a neck integral with the base portion forming a mouth through which liquid contents may be dispensed from the container, the base portion including a flat bottom surface for supporting the container with the neck section extending substantially perpendicular to the bottom surface, said wall being formed of a material so that said container is substantially incompressible;

the container wall including bottom portion extending from the base portion and the container including a shoulder extending between the base portion and the neck, the shoulder having two diametrically opposed, substantially flat support surfaces that each intersect the bottom portion at transition zones intermediate the neck and base portion, the shoulder including a front wall and a back wall each extending between said base portion and said neck and each forming an angle with said base portion, the front wall and the back wall being diametrically opposite each other, the front wall and back wall being circumferentially between the flat support surfaces;

a dispensing valve means positioned on said neck portion for controlling the flow of liquid out of the container through the mouth of the container; and the container wall having a shape that when the container is filled with liquid the center of gravity of the filled container is located between the mouth of the container and an axis extending perpendicular to the support surfaces at the transition zones, whereby the container is stable in an upright position supported by the bottom surface and in a pouring position with one of the support surfaces of the container resting on a horizontal surface.

37. A liquid container and dispensing system in accordance with claim 36, wherein lines extending along said substantially flat support surfaces intersect said neck section.

* * * * *